US005811214A

United States Patent [19]

Osterhoudt et al.

[11] Patent Number: 5,811,214

[45] Date of Patent: Sep. 22, 1998

[54] MONOCOMPONENT DEVELOPER COMPRISING SURFACE TREATED TONERS

[75] Inventors: Hans W. Osterhoudt, Spencerport; Robert C. Storey, Rochester; Dinesh Tyagi, Fairport, all of N.Y.

[73] Assignee: Eastman Kodak Company, Rochester, N.Y.

[21] Appl. No.: 852,985

[22] Filed: May 8, 1997

[51] Int. Cl.[6] ..... G03G 9/08

[52] U.S. Cl. ..... 430/106.6; 430/111

[58] Field of Search ..... 430/106.6, 109, 430/110, 111

[56] References Cited

U.S. PATENT DOCUMENTS

| | | | |
|---|---|---|---|
| 5,066,558 | 11/1991 | Hikake et al. | 430/104 |
| 5,179,159 | 1/1993 | Kishita et al. | 524/860 |
| 5,504,559 | 4/1996 | Ojima et al. | 355/211 |

*Primary Examiner*—John Goodrow
*Attorney, Agent, or Firm*—John R. Everett

[57] ABSTRACT

A monocomponent electrostatographic developer is disclosed. The developer contains a negative charging toner wherein the toner particle surface contains particles of cerium dioxide and a mixture of two hydrophobic silicon dioxides having a particle size of 0.005 to 0.03 $\mu$m.

17 Claims, No Drawings

MONOCOMPONENT DEVELOPER COMPRISING SURFACE TREATED TONERS

CROSS REFERENCE TO RELATED APPLICATIONS

U.S. patent application Ser. No. 08/846,057 entitled "MONOCOMPONENT DEVELOPER COMPRISING SURFACE TREATED TONERS" filed Apr. 25, 1997, in the name of Robert C. Storey et al.

FIELD OF THE INVENTION

This invention relates to electrostatography, particularly toners for electrostatographic image development methods.

BACKGROUND OF THE INVENTION

In electrostatography, an image comprising a pattern of electrostatic potential (also referred to as an electrostatic latent image), is formed on a surface of an electrophotographic element and is then developed into a toner image by contacting the latent image with an electrographic developer. If desired, the latent image can be transferred to another surface following development. The toner image may be transferred to a receiver, to which it is fused, typically by heat and pressure.

Electrostatographic developers can be monocomponent or two component developers. Two component developers comprise a mixture of carrier and toner particles. Monocomponent developers comprise nonmagnetic or magnetic toner particles but do not have separate carrier particles. Monocomponent developers can have additional components such as flow agents, and cleaning aids.

Cleaning aids in monocomponent developers are present to prevent an accumulation of toner or toner components on photoconductive elements. Silica, titania, alumina, zirconium oxide and cerium dioxide among others are disclosed as cleaning aids.

Flow agents in monocomponent developer compositions are present to facilitate toner flow from the replenishment hopper to the developer station and the distribution of toner on the shell of the developer station. Silica, titania, alumina, finely divided polymers, zinc stearate are disclosed as flow agents.

U.S. Pat. No. 5,504,559 discloses two types of silica in a two component developer. U.S. Pat. No. 5,066,558 discloses the use of one type of silica added to a monocomponent developer such that a certain fraction is well embedded in the surface of the magnetic toner particles and a lesser fraction is attached but not embedded.

Many prior art monocomponent developers fail to provide outstanding image quality, good fusing to receivers, acceptable release from the fusing member, and adequate suppression of photoconductor contamination.

SUMMARY OF THE INVENTION

The present invention provides a monocomponent electrostatographic developer comprising negatively charging toner particles comprising a polymeric binder, magnetic material and charge-control agent wherein the toner particle surface contains particles of (a) cerium dioxide, (b) dimethyldichlorosilane treated silica having a particle size of 0.005 to 0.03 $\mu$m and (c) dimethylsiloxane treated silica having a particle size of 0.005 to 0.03 $\mu$m.

This developer provides outstanding image quality, good fusing to receivers, acceptable release from the fusing member, and adequate suppression of photoconductor contamination.

The present invention also provides a method of preparing a monocomponent electrostatographic developer comprising the steps of:

providing negatively charging toner particles comprising a polymeric binder, magnetic material and charge-control agent;

treating the toner surface with a mixture of dimethyldichlorosilane treated silica having a particle size of 0.005 to 0.03 $\mu$m and dimethylsiloxane treated silica having a particle size of 0.005 to 0.03 $\mu$m; and thereafter treating the toner surface with cerium dioxide.

DETAILED DESCRIPTION OF THE INVENTION

The toners of the monocomponent developer contain a polymeric binder, charge control agent and a magnetic material. Optionally the toner may include a release agent, colorants and other additives. Electrostatographic toners are commonly made by polymerization of selected monomers followed by mixing with various additives and then grinding to a desired size range.

The desired polymeric binder for toner application is first produced. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt blending of toner addenda, including the magnetic material, into the bulk of the polymer.

The polymer may be made using a limited coalescence reaction such as the suspension polymerization procedure disclosed in U.S. Pat. No. 4,912,009 to Amering et al.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Also included are fusible styrene-acrylic copolymers that are covalently lightly crosslinked with a divinyl compound such as divinylbenzene. See U.S. Reissue Pat. No. 31,072.

Copolymers rich in styrene such as styrene butylacrylate and styrene butadiene are also useful as binders as are blends of polymers. In such blends the ratio of styrene butylacrylate to styrene butadiene is 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful polymers.

Styrene polymers include styrene, alpha-methylstyrene, para-chlorostyrene, and vinyl toluene; and alkyl acrylates or methylacrylates or monocarboxylic acids having a double bond selected from the group consisting of acrylic acid, methyl acrylate, 2-ethylhexyl acrylate, 2-ethylhexyl methacrylate, ethyl acrylate, butyl acrylate, dodecyl acrylate, octyl acrylate, phenyl acrylate, methylacrylic acid, ethyl methacrylate, butyl methacrylate and octyl methacrylate.

Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol and bisphenols.

A useful binder can also be formed from a copolymer of a vinyl aromatic monomer; a second monomer selected from either conjugated diene monomers or acrylate monomers such as alkyl acrylate and alkyl methacrylate.

The magnetic materials included in the toner are generally of the soft type magnetic materials disclosed in the prior art. Examples of useful magnetic materials include mixed oxides of iron, iron silicon alloys, iron aluminum, iron aluminum silicon, nickel iron molybdenum, chromium iron, iron nickel copper, iron cobalt, oxides of iron and magnetite.

The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; 4,394,430 and British Patent Nos. 1,501,065; and 1,420,839. Additional charge control agents which are useful are described in U.S. Pat. Nos. 4,624,907; 4,814,250; 4,840,864; 4,834,920; 4,683,188 and 4,780,553. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarboxamidato(2-)], ammonium, sodium and hydrogen (Organoiron available from Hodogaya Chemical Company Ltd.).

Release agents are useful additives in some copier configurations. Useful release agents are well known in this art. These include low molecular weight polypropylene, natural waxes, low molecular weight synthetic polymer waxes, commonly accepted release agents, such as stearic acid and salts thereof, and others. More specific examples are copolymers of ethylene and propylene having a molecular weight 1000–5000 g/mole, particularly a copolymer of ethylene and propylene having a molecular weight about 1200 g/mole.

An optional additive for the toner is a colorant. In some cases the magnetic component acts as a colorant negating the need for a separate colorant. Suitable dyes and pigments are disclosed, for example, in U.S. Reissue Pat. No. 31,072 and in U.S. Pat. Nos. 4,160,644; 4,416,965; 4,414,152; and 2,229,513. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent.

In preparing the monocomponent developer the toner is first treated with a mixture of silicon dioxides. Thereafter the toner is treated with cerium dioxide. In the first step, based on the weight of the toner, the toner surface is treated with a mixture of dimethyldichlorosilane treated silica having a particle size of 0.005 to 0.03 $\mu$m and dimethylsiloxane treated silica having a particle size of 0.005 to 0.03 $\mu$m wherein the ratio of dimethyldichlorosilane treated silica to dimethylsiloxane treated silica is 90:10 to 10:90. In the second step the toner is treated with from 1.0 to 6.0 weight percent cerium dioxide based on the total weight of the mixture of toner and silicon dioxide.

The silica dioxide is dimethyldichlorosilane treated and dimethylsiloxane treated. Both materials are commercially available from Degussa as Aerosil R 972 (Type A in Tables 1 and 2)) and R 202 (Type C in Tables 1 and 2).

The cerium dioxide added to the developer can be either pure cerium dioxide or cerium oxide-rich polishing aids. The cerium oxide particles have a mean volume average particle size of 0.5 to 5 microns. Cerium dioxide and cerium dioxide-rich polishing aids are commercially available from Transelco Division of the Ferro Corporation and Microabrasives Corporation.

The developer is generally made in several steps. In the first step the polymer, magnetic material, release agent and charge control agent are melt blended in a two roll mill or an extruder. The blend is ground, and classified to achieve a particular toner size distribution. The toner has a number average mean diameter between 3 to 15 $\mu$m, or has a volume average mean diameter between 5 and 20 $\mu$m. The desired toner has a number average mean diameter between 6.5 to 8.5 $\mu$m and a volume average mean diameter between 8.5 to 10.5 $\mu$m . To the toner is added the mixture of silicon dioxide particles and cerium dioxide particles and mixed according to the procedural steps described above and exemplified in the following examples. Mixing is carried out in a high-speed mixer, such as a Henschel mixer. As stated above the silicon dioxides are added in a first mixing step and the cerium dioxide particles in a second mixing step.

The toner comprises, based on the weight of the toner, 40 to 60% polymer; 30 to 55% magnetic material; optionally 1 to 5% release agent; 1 to 4% charge control agent and the concentration of silicon dioxides and cerium dioxide described above.

The toner can also contain other additives of the type used in previous toners, including magnetic pigments, leveling agents, surfactants, stabilizers, and the like.

The term "particle size" used herein, or the term "size", or "sized" as employed herein in reference to the term "toner particles", means the mean volume average diameter as measured by conventional measuring devices, such as a Coulter Multisizer, sold by Coulter, Inc. of Hialeah, Fla.

EXAMPLES

The following examples will further clarify the monocomponent developer of the invention and the method by which the developer is made. Surface treatment materials used in the examples are listed in Table 1:

TABLE 1

| | Name | BET Surface Area (m^2/g/m) | Avg. Primary Particle Size (nm) | % $SiO_2$ | Silane Treatment |
|---|---|---|---|---|---|
| Hydrophobic Silicon Dioxide B | Aerosil R 812[a] | 260 ± 30 | 7 | >99.8 | Hexamethyldisilazane |
| Hydrophobic Silicon Dioxide A | Aerosil R 972[a] | 110 ± 20 | 16 | >99.8 | Dimethyldichloro Silane |
| Hydrophobic Silicon Dioxide C | Aerosil R 202[a] | 90 ± 20 | 14 | >99.8 | Dimethlysiloxane |
| Cerium Dioxide | CERITE 4191[b] | | 2.5 × 10^3 | | |

[a]Available from Degussa
[b]Available from Ferro Corporation

Example 1

A toner is prepared according to the formulation recipe below:

Monocomponent Toner Core Production

| | |
|---|---|
| Styrene butylacrylate/butylmethacrylate polymer | 36.1% |
| Styrene butadiene copolymer | 15.4% |
| Magnetite | 45.0% |
| Organoiron complex | 1.5% |
| Ethylene-propylene copolymer wax | 2.0% |

The above materials were melt blended on a twin screw extruder at about 120° C. average zone temperature to yield a uniform dispersion. The blended material was then jet milled and classified to give a toner product with an average volume particle size distribution of about 10.0$\mu$.

Monocomponent Developer Production

The toner prepared in the above example was blended in a two step operation with a silicon dioxide (comparative examples 1–4), or mixture of two silicon dioxides (examples 1–4 and comparative examples 5–7) and cerium dioxide (CERITE 4191). The mixture was effected using a Henschel high intensity mixer. In step 1 of the surface treatment the silicon dioxide(s) was dry blended for the time indicated in Table 2 with toner from above under high shear conditions. In a second step also under high shear conditions, 3.0% by weight of $CeO_2$ was dry blended with the toner and $SiO_2$ from Step 1 above, for one additional minute to yield the final developer. The weight of the $CeO_2$ was based on the weight of the entire mixture.

Table 2, infra, describes the contents mixed in each of the following examples

Example 1

0.15 parts of Silica A, which was R972 available from Degussa and 0.15 parts of Silica C, which was R202 available from Degussa (total Silica level=0.3%) were blended with 100 parts of the core toner under the conditions specified in Table 2 using a Henschel Mixer. The resultant developer was subjected to a 15K print full system printing test on an EK 95 mid-volume copier and the printed copies and the photoconductor drum were evaluated. No film scumming defect was observed in either the printed copies or on the photoconductive (PC) drum.

Example 2

0.2 parts of Silica A and 0.2 parts of Silica C (total Silica=0.4%) were blended with 100 parts of the core toner under the conditions specified in Table 2 using a Henschel Mixer. The resultant developer was subjected to a 15K print full system printing test on an EK 95 mid-volume copier and the printed copies and the photoconductor drum were evaluated. No film scumming defect was observed in either the printed copies or on the PC drum.

Example 3

0.25 parts of Silica A and 0.25 parts of Silica C (total Silica=0.5%) were blended with 100 parts of the core toner under the conditions specified in Table 2 using a Henschel Mixer. The resultant developer was subjected to a 15K print full system printing test on an EK 95 mid-volume copier and the printed copies and the photoconductor drum were evaluated. No film scumming defect was observed in either the printed copies or on the PC drum, however a developer flow non-uniformity was evident on the toning roll and in the printed copies.

Example 4

0.28 parts of Silica A and 0.07 parts of Silica C (total Silica=0.35%) were blended with 100 parts of the core toner under the conditions specified in Table 2 using a Henschel Mixer. The resultant developer was subjected to a 15K print full system printing test on an EK 95 mid-volume copier and the printed copies and the photoconductor drum were evaluated. No film scumming defect was observed in either the printed copies or on the PC drum.

Comparative Example 1

0.3 parts of Silica C (total Silica=0.3%) were blended with 100 parts of the core toner under the conditions specified in Table 2 using a Henschel Mixer. The resultant developer was subjected to a 15K print full system printing test on an EK 95 mid-volume copier and the printed copies and the photoconductor drum were evaluated. No film scumming defect was observed in either the printed copies or on the PC drum and no developer flow defects were noted. Initial printing density, however was very high, leading to low resolution high density images.

Comparative Examples 2 through 4

Developers were made using only Silica A under the conditions specified in Table 2. Silica percentages ranged between 0.3 to 0.5%. All three developers showed signs of film scumming during the 15K print test. In addition, the high concentration of silica exhibited the developer flow non-uniformity noted in Example 3.

Comparative Examples 5 through 7

An alternative silica material, Silica B, which had been treated with hexamethyl disilazane and is available from Degussa as R812, was mixed 50%/50% with Silica A at total silica levels ranging between 0.3 to 0.5% and blended with the standard core material as indicated in Table 2. The film scum defect was noted at the 0.3 and 0.4% Silica levels. Although no film scum defect was noted at the 0.5% silica level (Comparative example 7) the high silica level caused the developer flow non-uniformity problem noted with the other high silica developers.

TABLE 2

| Developer Number | $SiO_2$ Level (%) | $SiO_2$ Mixing Speed (RPM) | $SiO_2$ Mixing Time (Min) | $SiO_2$ Type | $SiO_2$ Ratio (%) | Film Scum Defect | Developer Flow Non-uniformity |
|---|---|---|---|---|---|---|---|
| Example 1 | 0.30 | 3000 | 9 | A+C | 50/50 | o | o |
| Example 2 | 0.40 | 1500 | 6 | A+C | 50/50 | o | o |
| Example 3 | 0.50 | 2200 | 3 | A+C | 50/50 | o | Δ |
| Example 4 | 0.35 | 2500 | 6 | A+C | 80/20 | o | o |
| Comparative Example 1 | 0.30 | 1500 | 6 | C | 100 | o | o |
| Comparative | 0.30 | 1500 | 3 | A | 100 | Δ | o |

TABLE 2-continued

| Developer Number | $SiO_2$ Level (%) | $SiO_2$ Mixing Speed (RPM) | $SiO_2$ Mixing Time (Min) | $SiO_2$ Type | $SiO_2$ Ratio (%) | Film Scum Defect | Developer Flow Non-uniformity |
|---|---|---|---|---|---|---|---|
| Example 2 | | | | | | | |
| Comparative Example 3 | 0.40 | 2200 | 9 | A | 100 | Δ | o |
| Comparative Example 4 | 0.50 | 3000 | 6 | A | 100 | s | Δ |
| Comparative Example 5 | 0.30 | 2200 | 6 | A+B | 50/50 | h | o |
| Comparative Example 6 | 0.40 | 3000 | 3 | A+B | 50/50 | s | o |
| Comparative Example 7 | 0.50 | 1500 | 9 | A+B | 50/50 | o | Δ |

Defect Key
o = none
s = some
Δ = moderate
h = heavy

The invention has been described in detail with particular reference to certain preferred embodiments thereof, but it will be understood that variations and modifications can be effected within the spirit and scope of the invention.

What is claimed is:

1. A monocomponent electrostatographic developer comprising negatively charging toner particles comprising a polymeric binder, magnetic material and charge-control agent wherein the toner particle surface contains particles of (a) cerium dioxide, (b) dimethyldichlorosilane treated silica having a particle size of 0.005 to 0.03 μm and (c) dimethylsiloxane treated silica having a particle size of 0.005 to 0.03 μm.

2. The developer of claim 1 wherein the toner surface contains, based on the weight of the toner, (a) from 0.2 to 0.6 total weight percent of silicon dioxide; wherein the ratio of dimethyldichlorosilane treated silica to dimethylsiloxane treated silica is 90:10 to 10:90 and (b) from 1.0 to 6.0 weight percent cerium dioxide based on the total weight of the mixture of toner and silicon dioxide.

3. The developer of claim 2 wherein the toner surface bears from 2.0 to 4.0 weight percent cerium dioxide.

4. The developer of claim 3 wherein the ratio of silicon dioxides on the toner surface is 80:20 to 20:80.

5. The developer of claim 1 wherein the toner contains a release agent.

6. The developer of claim 1 or 2 wherein the polymeric binder comprises styrene and an alkyl acrylate and/or methacrylate and the styrene content of the binder at least 60 weight percent.

7. The developer of claim 6 wherein styrene is selected from the group consisting of styrene, alpha-methylstyrene, para-chlorostyrene, and vinyl toluene; and an alkyl acrylate and/or methacrylate or monocarboxylic acids having a double bond is selected from the group consisting of acrylic acid, methyl acrylate, 2-ethylhexyl acrylate, 2-ethylhexyl methacrylate, ethyl acrylate, butyl acrylate, dodecyl acrylate, octyl acrylate, phenyl acrylate, methylacrylic acid, ethyl methacrylate, butyl methacrylate and octyl methacrylate.

8. The developer of claim 1 wherein the polymeric binder is selected from the group consisting of styrene butylacrylate/butylmethacrylate polymer and styrene butadiene copolymer.

9. The developer of claim 1 wherein the charge-control agent is selected from the group consisting of chromium salicylate organo-complex salts and azo-iron complex-salts.

10. The developer of claim 9 wherein the charge control agent is ferrate (1-), bis[4-[(5-chloro-2-hydroxyphenyl)azo]-3-hydroxy-N-phenyl-2-naphthalenecarboxamidato(2-)], ammonium, sodium and hydrogen.

11. The developer of claim 5 wherein the wax is low molecular weight polypropylene, natural waxes, low molecular weight synthetic polymer waxes, stearic acid and salts thereof.

12. The developer of claim 5 wherein the release agent is a copolymer of ethylene and propylene having a molecular weight of 1000–5000 g/mole or a copolymer of ethylene and propylene having a molecular weight about 1200 g/mole.

13. A method of preparing a monocomponent electrostatographic developer comprising the steps of:

providing negatively charging toner particles comprising a polymeric binder, magnetic material and charge-control agent;

treating the toner surface with a mixture of dimethyldichlorosilane treated silica having a particle size of 0.005 to 0.03 μm and dimethylsiloxane treated silica having a particle size of 0.005 to 0.03 μm; and thereafter treating the toner surface with cerium dioxide.

14. The method of claim 13 wherein the toner surface is first treated with, based on the weight of the toner, (a) from 0.2 to 0.6 total weight percent of silicon dioxide; wherein the ratio of dimethyldichlorosilane treated silica to dimethylsiloxane treated silica is 90:10 to 10:90 and (b) from 1.0 to 6.0 weight percent cerium dioxide based on the total weight of the mixture of toner and silicon dioxide.

15. The method of claim 14 wherein the ratio of the silicon dioxides is 80:20 to 20:80.

16. The method of claim 15 wherein the ratio of the silicon dioxides is 50:50.

17. A method of electrostatographic imaging comprising the steps of:

forming an electrostatic latent image on a surface of an electrophotographic element and developing the image by contacting the latent image with a monocomponent electrostatographic developer; wherein the monocomponent developer comprises negatively charging toner particles containing a polymeric binder, magnetic material and charge-control agent wherein the toner particle surface contains (a) from 0.2 to 0.6 total weight percent of silicon dioxide; wherein the ratio of dimethyldichlorosilane treated silica to dimethylsiloxane treated silica is 90:10 to 10:90 and (b) from 1.0 to 6.0 weight percent cerium dioxide based on the total weight of the mixture of toner and silicon dioxide.

* * * * *